US007060922B2

(12) United States Patent
Hoehne et al.

(10) Patent No.: US 7,060,922 B2
(45) Date of Patent: Jun. 13, 2006

(54) PUSH BUTTON SWITCH

(75) Inventors: George Hoehne, St. Charles, IL (US); Martin Peek, Hoffman Estates, IL (US)

(73) Assignee: Gamesman Limited (GB)

( * ) Notice: Subject to any disclaimer, the term of this patent is extended or adjusted under 35 U.S.C. 154(b) by 80 days.

(21) Appl. No.: 10/827,128

(22) Filed: Apr. 19, 2004

(65) Prior Publication Data

US 2005/0230233 A1 Oct. 20, 2005

(51) Int. Cl.
*H01H 9/00* (2006.01)

(52) U.S. Cl. ..... 200/314; 200/310; 200/341

(58) Field of Classification Search ..... 200/520, 200/314, 345, 16 D, 310, 341
See application file for complete search history.

(56) References Cited

U.S. PATENT DOCUMENTS

| | | | | |
|---|---|---|---|---|
| 3,611,333 | A * | 10/1971 | Conigliaro | 340/539.14 |
| 5,134,505 | A | 7/1992 | Tanaka et al. | |
| 5,278,362 | A | 1/1994 | Ohashi | |
| 6,310,308 | B1 * | 10/2001 | Watson et al. | 200/520 |
| 6,454,649 | B1 | 9/2002 | Mattice et al. | |
| 2003/0067758 | A1 | 4/2003 | Shipman | |

FOREIGN PATENT DOCUMENTS

| | | | |
|---|---|---|---|
| DE | 201 18 189 | U1 | 2/2002 |
| EP | 1 143 468 | A2 | 10/2001 |
| EP | 1 347 363 | A1 | 9/2003 |
| EP | 1 398 808 | A1 | 3/2004 |
| GB | 2 195 206 | A | 3/1988 |
| WO | WO 02/091319 | A2 | 11/2002 |

OTHER PUBLICATIONS

"About Us Who we are . . . What we are", CDT Company Background, 4 pgs. Mar. 15, 2004.
Crista Souza, "CommsDesign—OLEDs compete for display market niche", Innovative Semiconductor Solutions, 2 pgs. Mar. 17, 2004.
"DuPont Displays and RiTdisplay open mass-production OLED line in Taiwan", optics.org—news, 2 pgs., Aug. 19, 2002.
Dupont Olight® Website—Olight® Technology, Olight® vs LCD, Olight® Benefits and Olight® Innovations—5 pgs. including top page—"Changing the way you see things"., Mar. 15, 2004.
DuPont cuts deals in displays and LEDs, "Holographic reflectors and poly-OLEDs will get a commercial boost from new licensing agreements", optics.org, May 2001, 2 pgs.

(Continued)

*Primary Examiner*—Richard K. Lee
(74) *Attorney, Agent, or Firm*—Schiff Hardin LLP

(57) ABSTRACT

A push button switch has a housing, a switch actuator movably supported by the housing, an organic light emitting diode display supported by the housing in a position to be viewable by a user of the push button switch, and a switch supported by the housing so as to operable by the switch actuator when the switch actuator moves relative to the housing. A controller circuit is electrically coupled to the push button switch so as to control the organic light emitting diode display in response to operation of the switch.

31 Claims, 10 Drawing Sheets

OTHER PUBLICATIONS

"LCD Switches Offer Control Designers New, Expansive Options", Special Section Switches/Relays, p. 53, Nov. 15, 2003.

Yamabico News—Operate with Message, "VD LCD Display Pushbutton Switch", 3 pgs., Mar. 15, 2004.

Weimer, "Intelligent Switches: LCD Plus Multi-Color Backlighting in a Pushbutton", Product Tech Highlight—Switches/Relays, 1 pg., Feb. 2001.

Japanese Abstract—JP 2003077357—"Switch With Display Function", Publication date: Mar. 14, 2003.

* cited by examiner

PUSH BUTTON SWITCH

TECHNICAL FIELD OF THE INVENTION

The present invention relates to a push button switch and, more particularly, to a push button switch having a lighted display device.

BACKGROUND OF THE INVENTION

Push button switches incorporating lighted displays have been used in a variety of applications such as on amusement, gaming, and vending machines. Such switches are typically comprised of a push button, an opaque legend plate, and a back light to illuminate the legend plate. This method only accommodates a single color background with a single stationary message or graphic.

A more recent configuration of an illuminated pushbutton switch used primarily in instrumentation includes a push button, a liquid crystal display (LCD) panel, and a back light to illuminate the liquid crystal display panel. Alternatively, it is known to mount the light that illuminates the liquid crystal display panel to the side of the panel. Such a push button switch has been used to convey information, such as the function of the push button switch, to the user.

The use of a liquid crystal display panel in a push button switch has a number of problems. For example, a liquid crystal display panel has a very narrow viewing angle. A narrow viewing angle is desirable for some applications such as computers where the user often does not wish the contents of the computer's screen to be seen by anyone other than the user. However, in many applications, such as where the display is being used to advertise information, a narrow viewing angle is a detriment.

Also, a liquid crystal display panel has a relatively slow response time, typically referred to as latency. This problem is exacerbated at low temperatures and, therefore, supplemental heating may be required for low temperature applications.

Moreover, a liquid crystal display panel requires backlighting, which adds to the cost of a push button switch and which also adds to the power consumption of a push button switch using a liquid crystal display panel.

The present invention is directed to a push button switch which overcomes one or more of these or other problems.

SUMMARY OF THE INVENTION

According to one aspect of the present invention, a push button switch comprises a housing, a switch actuator, an organic light emitting diode display, and a switch. The switch actuator is movably supported by the housing. The organic light emitting diode display is supported by the housing in a position to be viewable by a user of the push button switch. The switch is supported by the housing so as to be operable by the switch actuator when the switch actuator moves relative to the housing.

According to another aspect of the present invention, a push button switch comprises a housing, a switch actuator, an organic light emitting diode display, a switch, and a controller circuit. The switch actuator is movably supported by the housing. The organic light emitting diode display is supported by the housing in a position to be viewable by a user of the push button switch. The switch is supported by the housing so as to be operable by the switch actuator when the switch actuator moves relative to the housing. The controller circuit is supported within the housing and is coupled so as to control the organic light emitting diode display in response to the switch.

According to still another aspect of the present invention, an assembly comprises a push button switch and a controller circuit. The push button switch has a housing, a switch actuator movably supported by the housing, an organic light emitting diode display supported by the housing in a position to be viewable by a user of the push button switch, and a switch supported by the housing so as to be operable by the switch actuator when the switch actuator moves relative to the housing. The controller circuit is electrically coupled to the push button switch so as to control the organic light emitting diode display in response to operation of the switch.

BRIEF DESCRIPTION OF THE DRAWINGS

These and other features and advantages will become more apparent from a detailed consideration of the invention when taken in conjunction with the drawing in which.

DETAILED DESCRIPTION

Figure 1:
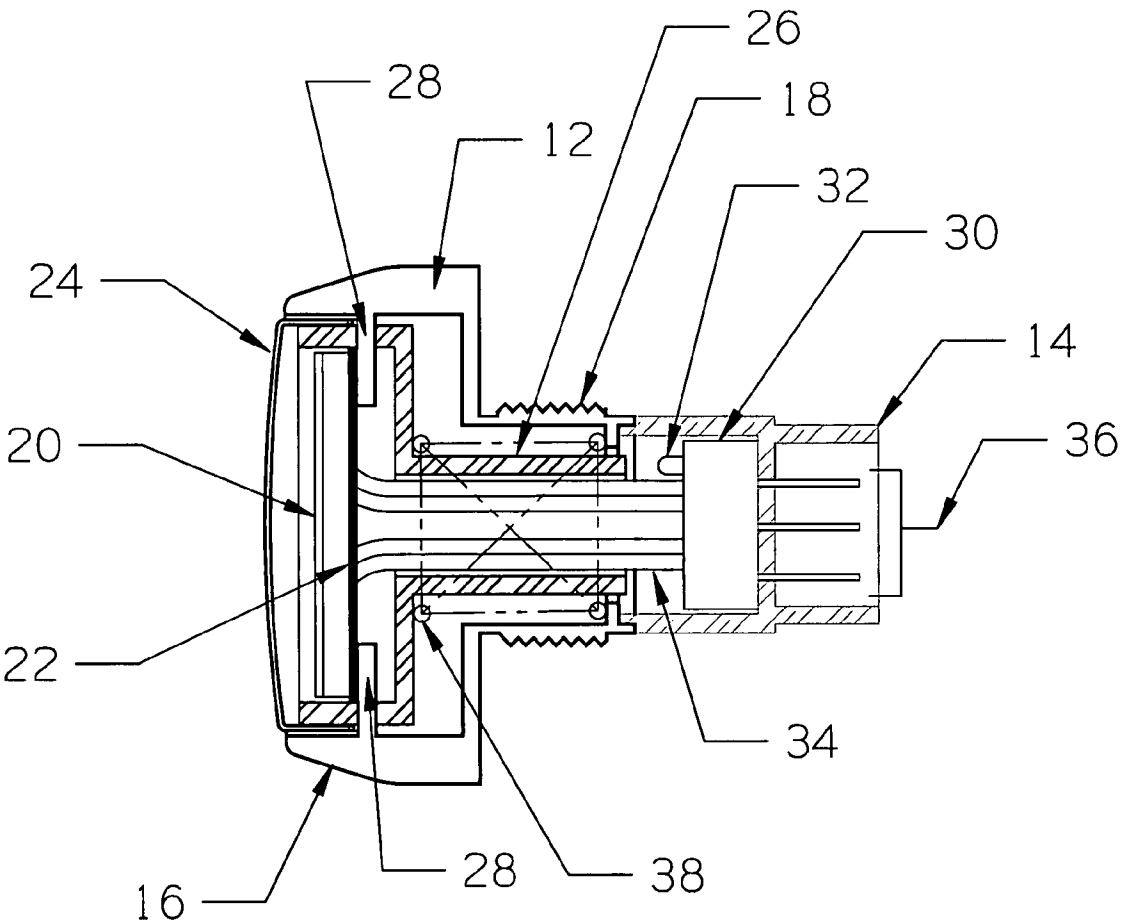
FIG. 1 shows a push button switch according to a first embodiment of the present invention.

FIG. 1 shows a push button switch 10 as a first embodiment of the present invention. The push button switch 10 includes a button housing 12 and a switch housing 14 that are affixed together. As shown in FIG. 1, the button housing 12 may have a bezel 16 and may be externally threaded at 18 to facilitate the mounting of the push button switch 10 to an apparatus such as an amusement, gaming, or vending machine.

The button housing 12 houses an organic light emitting diode (OLED) display 20, a controller circuit 22, a transparent cover 24, and a sliding actuator 26. The transparent cover 24 may be a transparent lens cover. The controller circuit 22 is suitably affixed to a plurality of tabs 28 formed by the button housing 12.

Organic light emitting diode (OLED) displays are known and may be obtained, for example, from Dupont. Generally, an organic light emitting diode is a composite of a thin film of light emitting polymer applied to a glass or plastic substrate. In the presence of an electric field, the polymer emits light.

The organic light emitting diode (OLED) display 20 is suitably affixed to the controller circuit 22, and the transparent cover 24 is affixed to the outside perimeter of the sliding actuator 26. For example, the transparent cover 24 may be arranged to snap onto the sliding actuator 26. Accordingly, the organic light emitting diode (OLED) display 20 remains stationary as the sliding actuator 26 moves.

Figure 10:
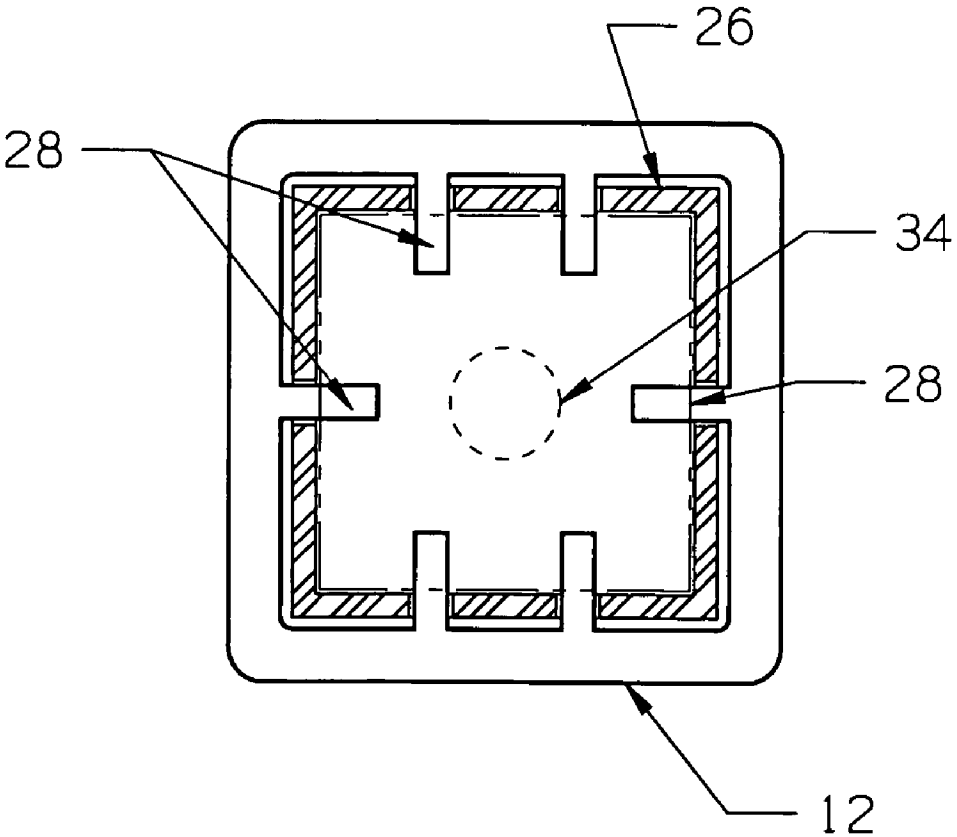

However, the transparent cover 24 moves with the sliding actuator 26. As shown in FIG. 10, the transparent cover 24 and the sliding actuator 26 may be notched at the tabs 28 to permit the transparent cover 24 and the sliding actuator 26 to move with respect to the button housing 12. The notches may be formed so that the bottoms of the notches in the sliding actuator 26 abut the tabs 28 in the non-depressed position of the push button switch 10. In this manner, the organic light emitting diode (OLED) display 20, the transparent cover 24, and the sliding actuator 26 are retained to the button housing 12.

The switch housing 14 houses a switch 30, such as a microswitch, having a switch operator 32 for operating the switch 30 in response to the sliding actuator 26. A display interconnect 34 interconnects the controller circuit 22 and the switch 30. The controller circuit 22 may be connected to the organic light emitting diode (OLED) display 20 by means of a connector or solder connections (not shown). Accordingly, the organic light emitting diode (OLED) display 20 is controlled by the controller circuit 22 in response to actuation of the switch 30. Also, a plurality of pins 36 are provided to couple the controller circuit 22 and/or the switch 30 to external devices.

A user, in operating the push button switch 10, pushes on the transparent cover 24 to push the sliding actuator 26 against the bias of a spring 38 so as to actuate the switch 30 through the switch operator 32. When the user releases pressure from the transparent cover 24, the spring 38 returns the transparent cover 24 to its original position.

Figure 2:
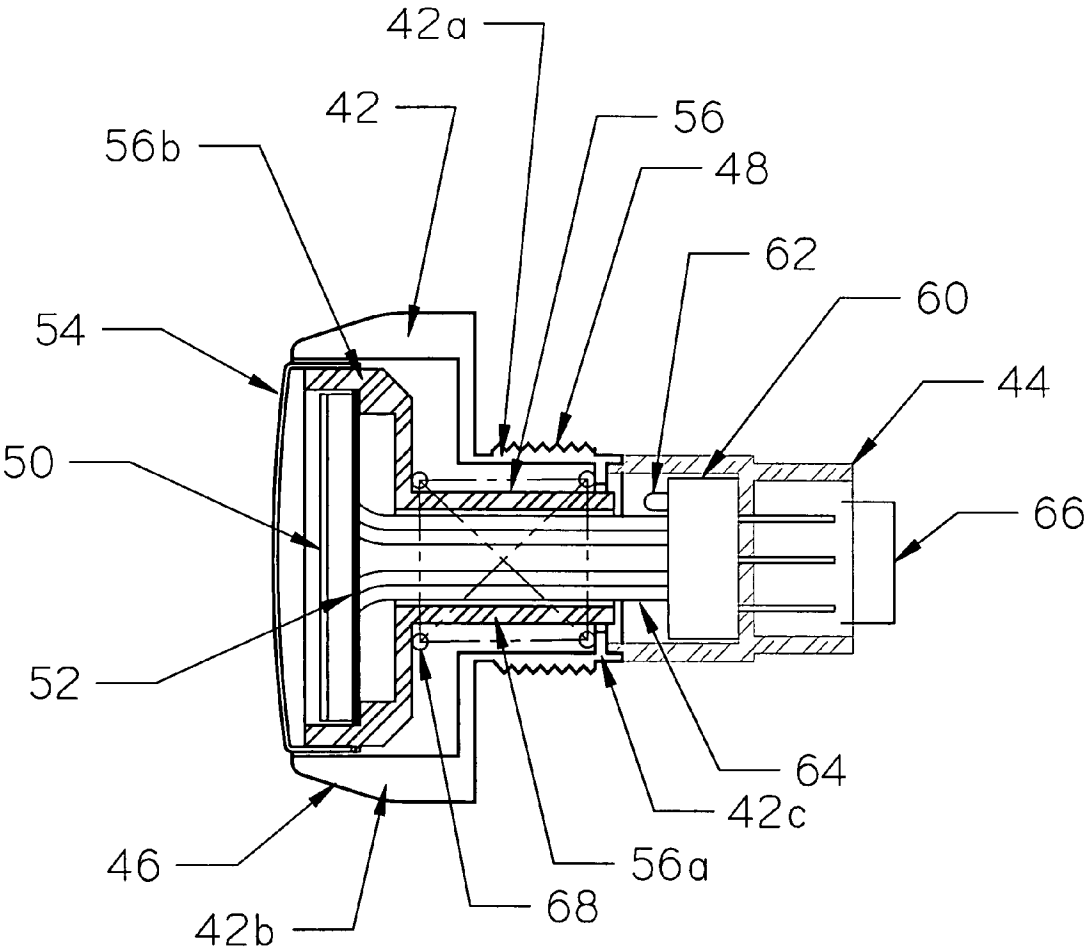
FIG. 2 shows a push button switch according to a second embodiment of the present invention.

FIG. 2 shows a push button switch 40 as a second embodiment of the present invention. The push button switch 40 includes a button housing 42 and a switch housing 44 suitably affixed together. The button housing 42 may have a bezel 46 and may be externally threaded at 48 to facilitate the mounting of the push button switch 40 to an apparatus such as an amusement, gaming, or vending machine.

The button housing 42 houses an organic light emitting diode (OLED) display 50, a controller circuit 52, a transparent cover 54, and a sliding actuator 56. The transparent cover 54 may be a transparent lens cover. The controller circuit 52 is affixed to the inside perimeter of the sliding actuator 56, the organic light emitting diode (OLED) display 50 is affixed to the controller circuit 52, and the transparent cover 54 is affixed to the outside perimeter of the sliding actuator 56. For example, the transparent cover 54 may be arranged to snap onto the sliding actuator 56. Accordingly, the organic light emitting diode (OLED) display 50, the controller circuit 52, and the transparent cover 54 move as the sliding actuator 56 moves.

A snap feature may be used to affix the barrel 56*a* of the sliding actuator 56 to the barrel 42*a* of the button housing 42. This snap feature allows the tray 56*b* of the sliding actuator 56 to move (to the right as viewed in FIG. 2) until it bottoms against the tray 42*b* of the button housing 42. The sliding actuator 56 returns (to the left as viewed in FIG. 2) under tension of the spring 68, but only as far as the stop created by the snap feature. This stop, for example, can be at the end of the barrel 56*a* of the sliding actuator 56 nearest the switch operator 62 so that it abuts against the inwardly directed flange 42*c* at the end of the barrel of the switch housing 42.

The organic light emitting diode (OLED) display 50 and the controller circuit 22 can be affixed to the sliding actuator 56 by means, for example, of a snap feature or an adhesive.

The switch housing 44 houses a switch 60, such as a microswitch, having a switch operator 62 for operating the switch 60 in response to the sliding actuator 56. A display interconnect 64 interconnects the controller circuit 52 and the switch 60. The controller circuit 52 may be connected to the organic light emitting diode (OLED) display 50 by means of a connector or solder connections (not shown). Accordingly, the organic light emitting diode (OLED) display 50 is controlled by the controller circuit 52 in response to actuation of the switch 60. Also, a plurality of pins 66 are provided to couple the controller circuit 52 and/or the switch 60 to external devices.

A user, in operating the push button switch 40, pushes on the transparent cover 54 to push the sliding actuator 56 against the bias of a spring 68 so as to actuate the switch 60 through the switch operator 62. When the user releases pressure from the transparent cover 54, the spring 68 returns the transparent cover 54 to its original position.

Figure 3:
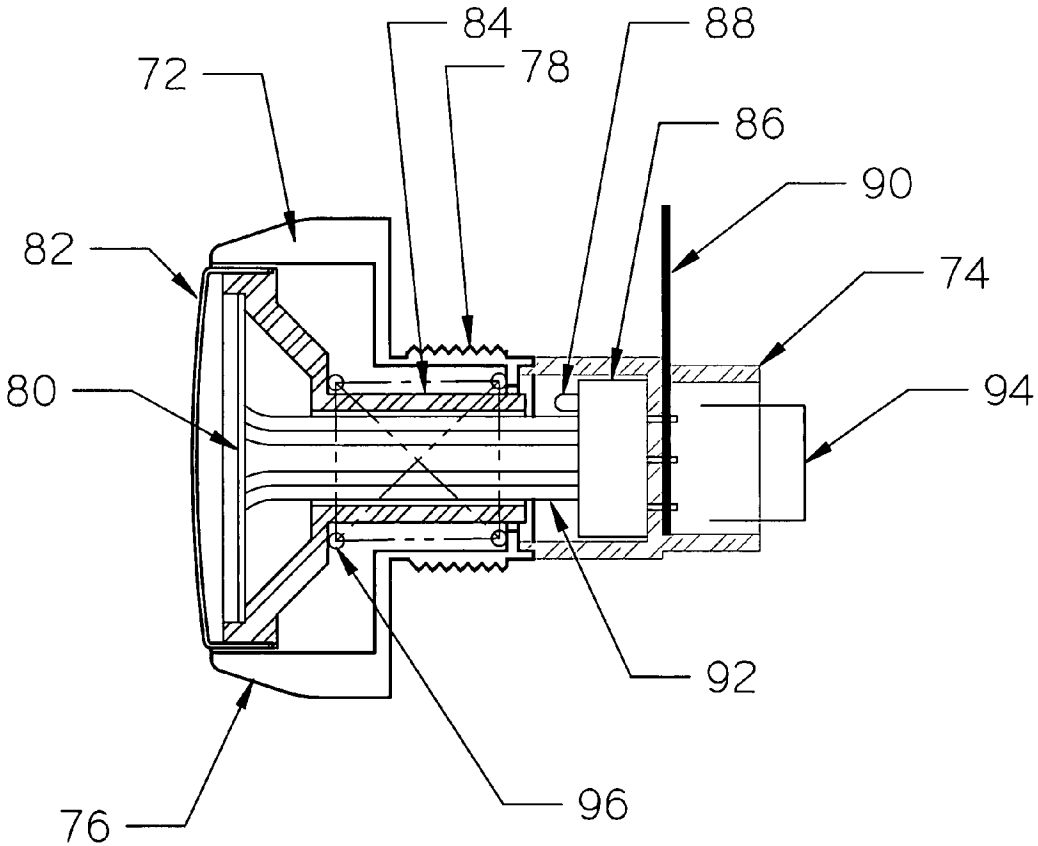
FIG. 3 shows a push button switch according to a third embodiment of the present invention.

FIG. 3 shows a push button switch 70 as a third embodiment of the present invention. The push button switch 70 includes a button housing 72 and a switch housing 74 suitably affixed together. The button housing 72 may have a bezel 76 and may be externally threaded at 78 to facilitate the mounting of the push button switch 70 to an apparatus such as an amusement, gaming, or vending machine.

The button housing 72 houses an organic light emitting diode (OLED) display 80, a transparent cover 82, and a sliding actuator 84. The transparent cover 82 may be a transparent lens cover. The organic light emitting diode (OLED) display 80 is affixed to the inside perimeter of the sliding actuator 84, and the transparent cover 82 is affixed to the outside perimeter of the sliding actuator 84. For example, the transparent cover 82 may be arranged to snap onto the sliding actuator 84. Accordingly, the organic light emitting diode (OLED) display 80 and the transparent cover 82 move as the sliding actuator 84 moves. The organic light emitting diode (OLED) display 80 can be affixed to the sliding actuator 84 by means, for example, of a snap feature or an adhesive.

A snap feature may be used to affix the sliding actuator 84 to the button housing 72 as discussed above in connection with FIG. 2.

The switch housing 74 houses a switch 86, such as a microswitch, having a switch operator 88 for operating the switch 86 in response to the sliding actuator 84. The switch housing 74 also supports a controller circuit 90. A display interconnect 92 interconnects the controller circuit 90 and the switch 86. The controller circuit 90 may be connected to the organic light emitting diode (OLED) display 80 by means of a connector or solder connections (not shown). Accordingly, the organic light emitting diode (OLED) display 80 is controlled by the controller circuit 90 in response to actuation of the switch 86. Also, a plurality of pins 94 are provided as part of the display interconnect 92.

A user, in operating the push button switch 70, pushes on the transparent cover 82 to push the sliding actuator 84 against the bias of a spring 96 so as to actuate the switch 86 through the switch operator 88. When the user releases pressure from the transparent cover 82, the spring 96 returns the transparent cover 82 to its original position.

Figure 4:
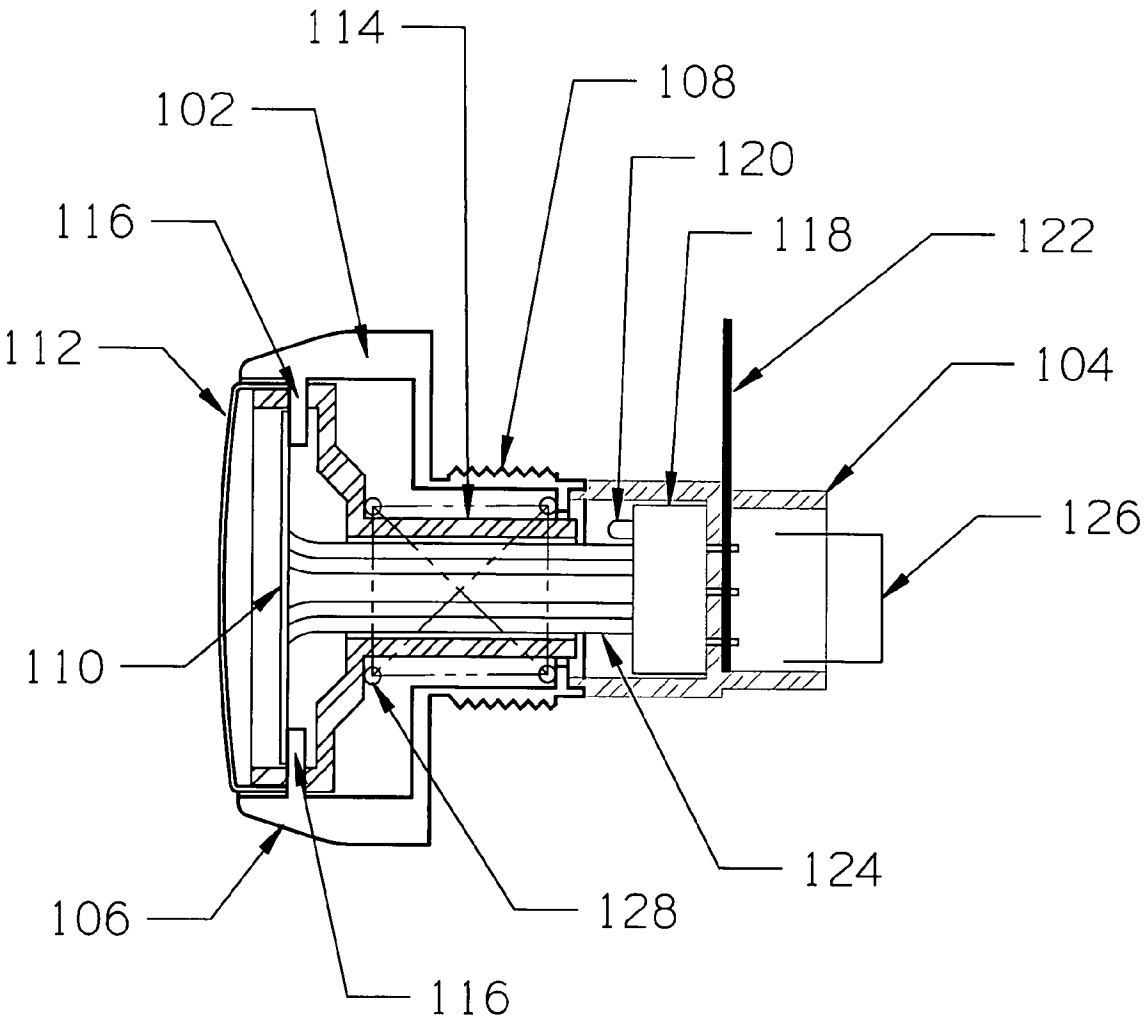
FIG. 4 shows a push button switch according to a fourth embodiment of the present invention.

FIG. 4 shows a push button switch 100 as a fourth embodiment of the present invention. The push button switch 100 includes a button housing 102 and a switch housing 104. As shown in FIG. 4, the button housing 102 may have a bezel 106 and may be externally threaded at 108 to facilitate the mounting of the push button switch 100 to an apparatus such as an amusement, gaming, or vending machine.

The button housing 102 houses an organic light emitting diode (OLED) display 110, a transparent cover 112, and a sliding actuator 114. The transparent cover 112 may be a transparent lens cover. The organic light emitting diode (OLED) display 110 is affixed to a plurality of tabs 116 formed by the button housing 102.

The transparent cover 112 is affixed to the outside perimeter of the sliding actuator 114. For example, the transparent cover 112 may be arranged to snap onto the sliding actuator 114. Accordingly, the transparent cover 112 moves with the sliding actuator 114. The transparent cover 112 and the sliding actuator 114 may be notched at the tabs 116 to permit the transparent cover 112 and the sliding actuator 114 to move with respect to the button housing 102. The notches may be formed so that the sliding actuator 114 abuts the tabs 116 in the non-depressed position of the push button switch 100. In this manner, the transparent cover 112 and the sliding actuator 114 are retained to the button housing 102.

The switch housing 104 houses a switch 118, such as a microswitch, having a switch operator 120 for operating the switch 118 in response to the sliding actuator 114. The switch housing 104 also supports a controller circuit 122. A display interconnect 124 interconnects the controller circuit 122 and the switch 118. The controller circuit 122 may be connected to the organic light emitting diode (OLED) display 110 by means of a connector or solder connections (not shown). Accordingly, the organic light emitting diode (OLED) display 110 is controlled by the controller circuit 122 in response to actuation of the switch 118. Also, a plurality of pins 126 are provided as part of the display interconnect 124.

A user, in operating the push button switch 100, pushes on the transparent cover 112 to push the sliding actuator 114 against the bias of a spring 128 so as to actuate the switch 118 through the switch operator 120. When the user releases pressure from the transparent cover 112, the spring 128 returns the transparent cover 112 to its original position.

Figure 5:
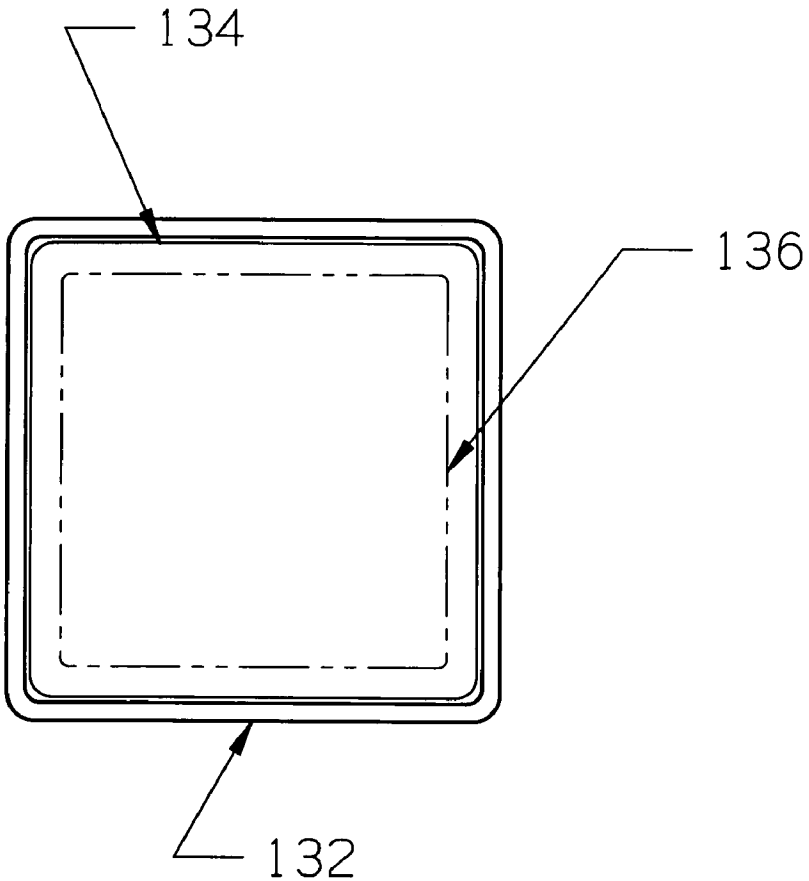
FIG. 5 is a frontal-view of the push button switches shown in FIGS. 1–4.

FIG. 5 is a frontal view of the push button switch 10/40/70/100 that includes the button housing 12/42/72/102, the transparent cover 24/54/82/112, and the organic light emitting diode (OLED) display 20/50/80/110 shown in phantom.

Figure 6:
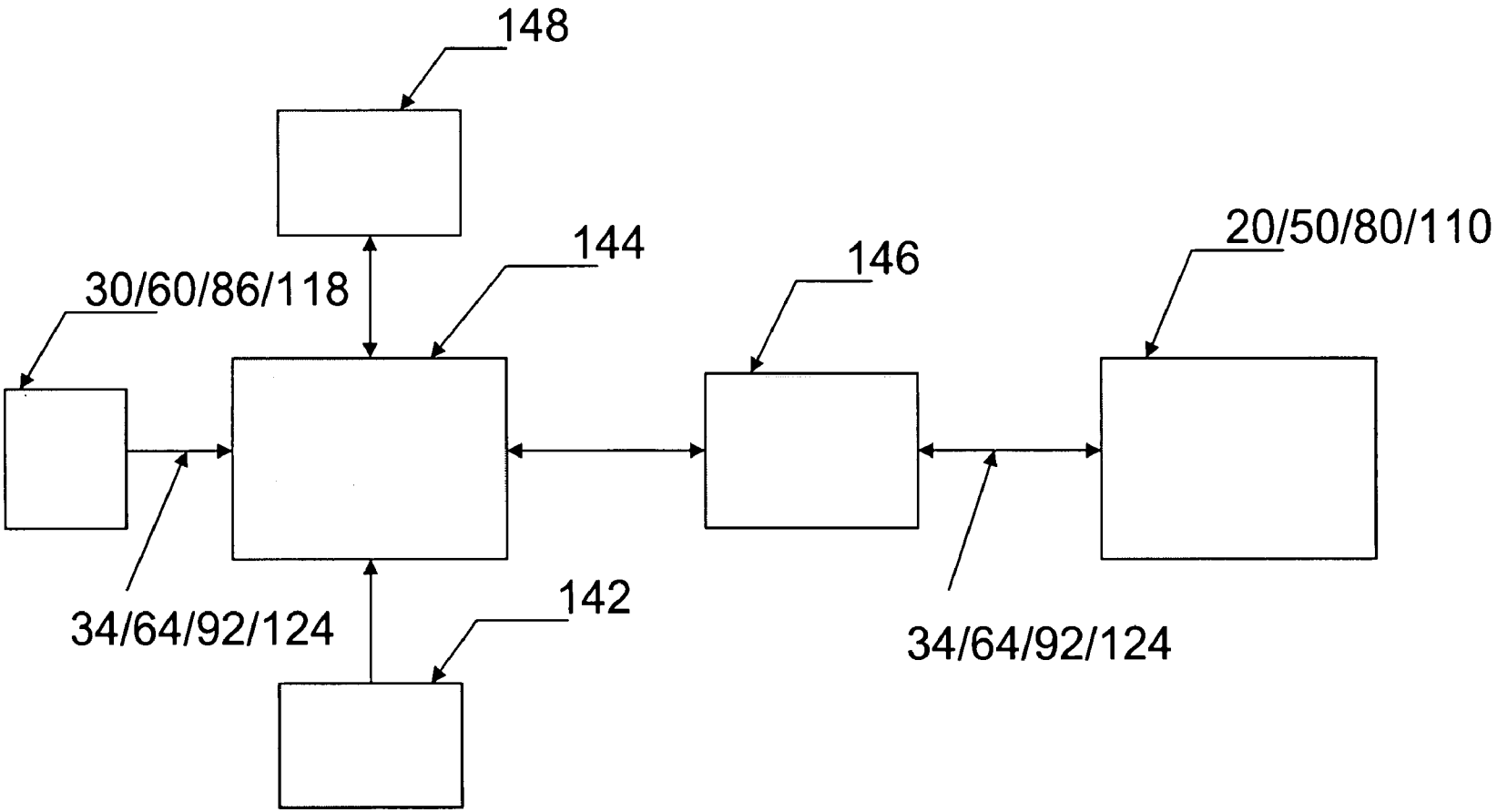
FIG. 6 illustrates an exemplary controller that can be used in connection with the push button switches of FIGS. 1–4.

A controller circuit 140 is shown in FIG. 6 and can be used for any of the controller circuits 22, 52, 90, and 122 described above. The controller 140 includes a power supply 142, a microcontroller 144, and a display driver 146. The power supply 142 may perform power management and supervisory functions. The microcontroller 144 is responsible for input/output, display driver management, and display update functions, and includes memory (e.g., flash and RAN). The display driver 146 manages row and column selection, buffer refresh, and display control functions for the organic light emitting diode (OLED) display 20/50/80/110, as appropriate. The display interconnect 34/64/92/124 interconnects the controller circuit 140 with the switch 30/60/86/118 and the organic light emitting diode (OLED) display 20/50/80/110, as appropriate.

Figure 7:
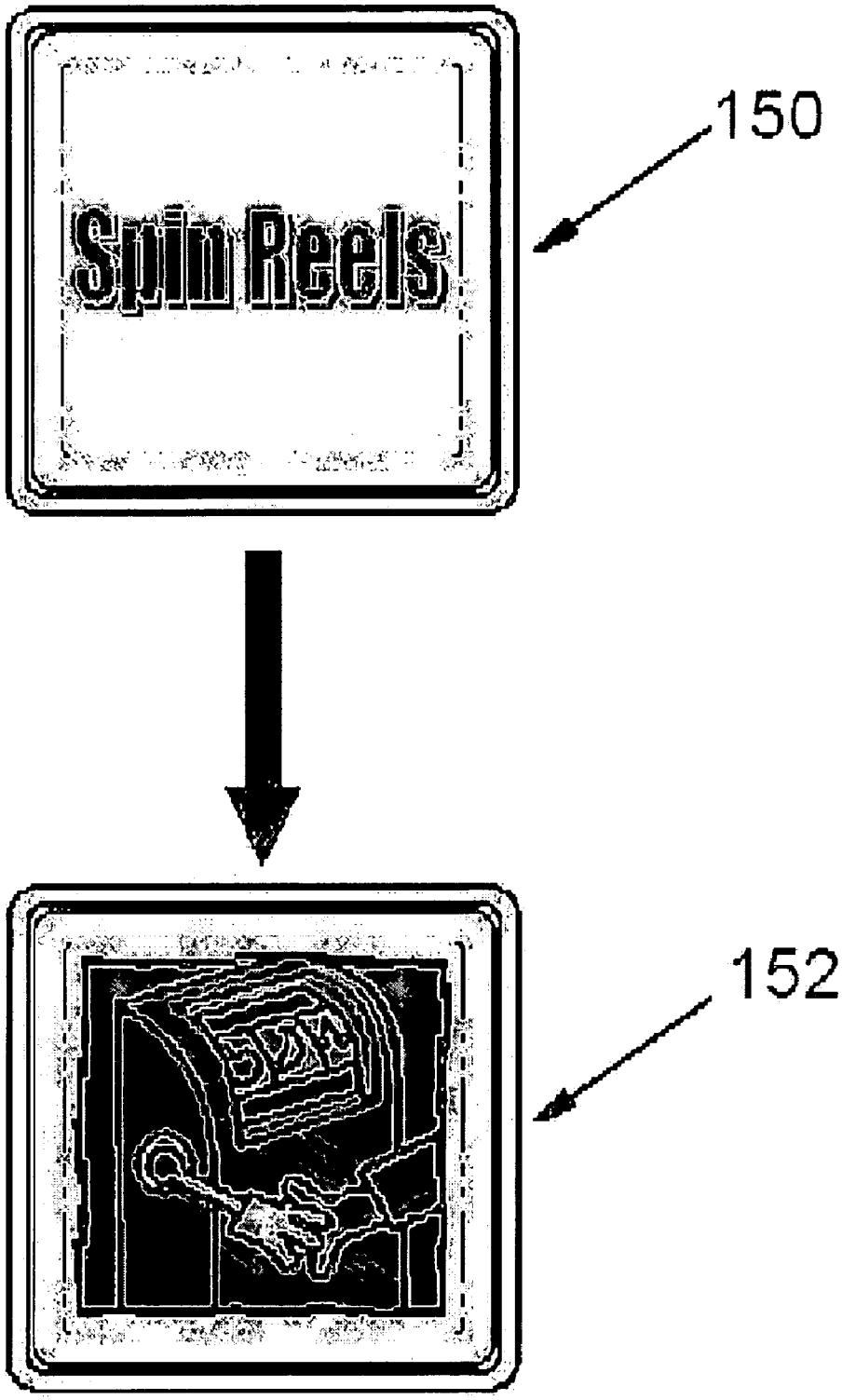
FIGS. 7–9 illustrates exemplary displays that can be programmed into the push button switches of FIGS. 1–4 and, FIG. 10 shows notches in the sliding actuator to permit movement of the sliding actuator in the embodiments of FIGS. 1 and 4.

The controller circuit 140 permits the push button switch to be programmed to perform various functions. For example, as shown in FIG. 7, the controller circuit 140 is programmed to cause the organic light emitting diode (OLED) display 20/50/80/110 to change from an instruction display 150 to a feedback display 152. Accordingly, the push button switches of the present invention enriches the experience of the user in using the associated machine.

Figure 8:
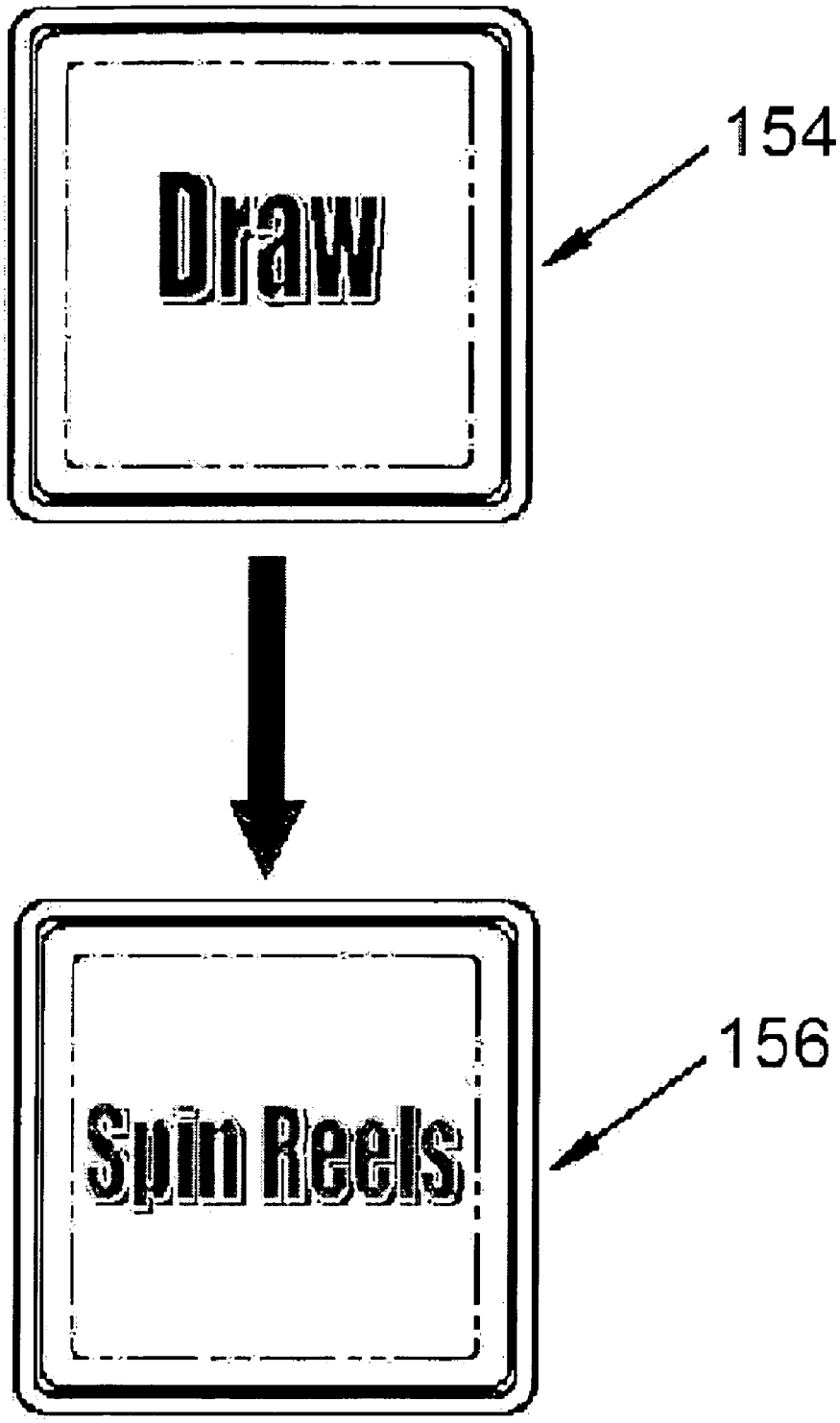

Alternatively, as shown in FIG. 8, the controller circuit 140 is programmed to cause the organic light emitting diode (OLED) display 20/50/80/110 to display multiple functions of the push button switch 10/40/70/100 such as a draw display 154 if the gaming machine with which the push button switch 10/40/70/100 is used is being operated as a poker machine or a spin display 156 if the gaming machine with which the push button switch 10/40/70/100 is used is being operated as a slot machine. Thus, the machine and its push button switches can be readily re-programmed, making the machine more versatile.

Figure 9:
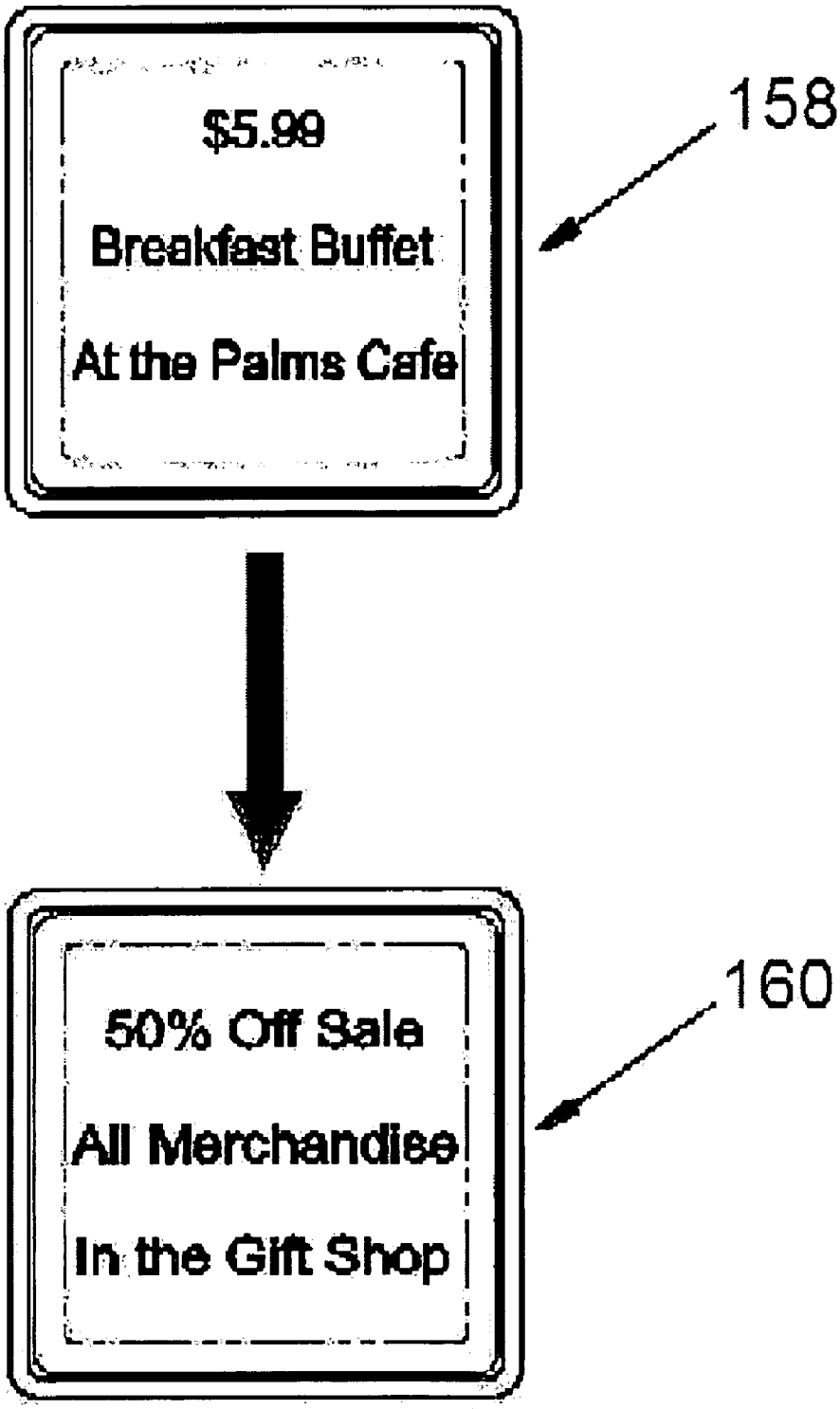

As a still further alternative, the controller circuit 140, as shown in FIG. 9, can be programmed to cause the organic light emitting diode (OLED) display 20/50/80/110 to display one or more advertisements such as advertisements 158 and 160.

Optionally, the controller circuit 140 can include a RF transceiver 148 in order to couple the controller circuit 140 with a remote station by way of an RF channel. In this way, the push button switch 10/40/70/100 and/or the machine with which the push button switch 10/40/70/100 is used may be programmed and re-programmed remotely.

A push button switch incorporating an organic light emitting diode (OLED) display provides many advantages over the prior art. For example, an organic light emitting diode (OLED) display has a wide viewing angle so that its displays can be more easily seen by users approaching a machine. Also, an organic light emitting diode (OLED) display has a very fast response time which allows the displays to be quickly changed during use of the machine without detracting from the experience of the user. Moreover, an organic light emitting diode (OLED) display requires no backlighting so that the machine is less costly to make and use.

Certain modifications of the present invention have been discussed above. Other modifications will occur to those practicing in the art of the present invention. For example, as described above, the controller circuit may be programmed to change the display of the organic light emitting diode display in response to actuation of the switch. Additionally, or alternatively, the controller circuit may be programmed to change the display of the organic light emitting diode display in response to the passage of time or in response to some other cause.

Also, as described above, the controller circuit 140 includes the RF transceiver 148 that couples the controller circuit 140 with a remote station by way of an RF channel. However, receiving devices other than the RF transceiver 148 may couple the controller circuit 140 to the remote station. For example, sound or light receivers can be used to couple the controller circuit 140 to the remote station. As a further alternative, the controller circuit 140 can be hard wired to the remote station.

Moreover, the controller circuit 22/52/90/122 is shown as being supported by the housing of the push button switch. Alternatively, the controller circuit 22/52/90/122 need not be supported by the housing of the push button switch. For example, the controller circuit 22/52/90/122 can be supported by the machine on which the push button switch is mounted.

Furthermore, the switch 30/60/86/118 is described above as being a microswitch. Alternatively, the switch 30/60/86/118 may be any other suitable type of switch such as a magnetic switch, an optical switch, etc.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A push button switch comprising:

a housing;

a switch actuator supported by the housing and moveable along a switch actuator axis;

an organic light emitting diode display supported by the housing in a position to be viewable by a user of the push button switch; and, a switch supported by the housing so as to be operable by the switch actuator when the switch actuator moves relative to the housing, wherein the housing is elongated along the switch actuator axis.

2. The push button switch of claim 1 further comprising a transparent cover mounted to the switch actuator such that the transparent cover covers the organic light emitting diode display.

3. The push button switch of claim 2 wherein the transparent cover is mounted to the switch actuator so as to move with the switch actuator, and wherein the organic light emitting diode display is mounted to the housing so that organic light emitting diode display remains stationary as the switch actuator moves.

4. The push button switch of claim 2 wherein the transparent cover is mounted to the switch actuator so as to move with the switch actuator, and wherein the organic light emitting diode display is mounted to the switch actuator so as to move with the switch actuator.

5. The push button switch of claim 1 wherein the elongated housing is externally threaded for threaded attachment to a host device.

6. The push button switch of claim 1 wherein the organic light emitting diode display is arranged to display variable words and/or graphics.

7. A push button switch comprising:

a housing having a display housing portion and an elongated housing portion extending perpendicularly away from the display portion;

a switch actuator movably supported by the elongated housing portion;

an organic light emitting diode display supported by the display housing portion in a position to be viewable by a user of the push button switch;

a switch supported by the elongated housing portion so as to be operable by the switch actuator when the switch actuator moves relative to the housing; and, a controller circuit supported by the housing and coupled so as to control the organic light emitting diode display in response to the switch.

8. The push button switch of claim 7 further comprising a transparent cover mounted to the switch actuator such that the transparent cover covers the organic light emitting diode display.

9. The push button switch of claim 8 wherein the transparent cover is mounted to the switch actuator so as to move with the switch actuator, wherein the organic light emitting diode display is mounted to the switch actuator so as to move with the switch actuator, and wherein the controller circuit is mounted to the switch actuator so as to move with the switch actuator.

10. The push button switch of claim 8 wherein the transparent cover is mounted to the switch actuator so as to move with the switch actuator, wherein the organic light emitting diode display is mounted to the switch actuator so as to move with the switch actuator, and wherein the controller circuit is mounted to the housing so that the controller circuit remains stationary as the switch actuator moves.

11. The push button switch of claim 8 wherein the transparent cover is mounted to the switch actuator so as to move with the switch actuator, wherein the organic light emitting diode display is mounted to display housing portion so that the organic light emitting diode display remains stationary as the switch actuator moves, and wherein the controller circuit is mounted to the housing so that the controller circuit remains stationary as the switch actuator moves.

12. The push button switch of claim 7 wherein the controller circuit is programmed to change displays of the organic light emitting diode display in response to actuation of the switch.

13. The push button switch of claim 7 wherein the controller circuit is programmed to change displays of the organic light emitting diode display in response to passage of time.

14. The push button switch of claim 7 wherein the controller circuit comprises a receiving device that couples the controller circuit to a remote station.

15. The push button switch of claim 14 wherein the controller circuit is programmed from the remote station by way of the receiving device to change displays of the organic light emitting diode display.

16. The push button switch of claim 14 wherein the remote receiving device comprises an RF receiver.

17. The push button switch of claim 7 wherein the elongated housing portion is externally threaded for threaded attachment to a host device.

18. The push button switch of claim 17 wherein the organic light emitting diode display is controlled by the controller circuit to display variable words and/or graphics.

19. An assembly comprising:

a push button switch having a housing, a switch actuator movably supported by the housing, an organic light emitting diode display supported by the housing in a position to be viewable by a user of the push button switch, and a switch supported by the housing so as to be operable by the switch actuator when the switch actuator moves relative to the housing, wherein the housing has at least a portion that is elongated in a direction extending perpendicularly away from the organic light emitting diode display, and wherein the switch is supported by the elongated portion of the housing; and, a controller circuit electrically coupled to the push button switch so as to control the organic light emitting diode display in response to operation of the switch.

20. The push button switch of claim 19 further comprising a transparent cover mounted to the switch actuator such that the transparent cover covers the organic light emitting diode display.

21. The push button switch of claim 19 wherein the organic light emitting diode display is mounted to the switch actuator so as to move with the switch actuator, and wherein the controller circuit is mounted to the housing so that the controller circuit remains stationary as the switch actuator moves.

22. The push button switch of claim 19 wherein the organic light emitting diode display is mounted to the switch actuator so as to move with the switch actuator, and wherein the controller circuit is mounted to the switch actuator so as to move with the switch actuator.

23. The push button switch of claim 19 wherein the controller circuit is programmed to change displays of the organic light emitting diode display in response to actuation of the switch.

24. The push button switch of claim 19 wherein the controller circuit is programmed to change displays of the organic light emitting diode display in response to passage of time.

25. The push button switch of claim 19 wherein the controller circuit comprises a receiving device that couples the controller circuit to a remote station.

26. The push button switch of claim 25 wherein the controller circuit is programmed from the remote station by way of the receiving device to change displays of the organic light emitting diode display.

27. The push button switch of claim 25 wherein the remote receiving device comprises an RF receiver.

28. The push button switch of claim 19 wherein the elongated portion of the housing is externally threaded for threaded attachment to a host device.

29. The push button switch of claim 19 wherein the organic light emitting diode display is controlled by the controller circuit to display variable words and/or graphics.

30. A push button switch comprising:

a housing;

a switch actuator movably supported by the housing;

an organic light emitting diode display supported by the housing in a position to be viewable by a user of the push button switch, wherein the organic light emitting diode display is mounted to the housing so that the organic light emitting diode display remains stationary as the switch actuator moves; and, a switch supported by the housing so as to be operable by the switch actuator when the switch actuator moves relative to the housing.

31. The push button switch of claim 30 wherein the organic light emitting diode display is arranged to display variable words and/or graphics.

* * * * *

US007060922C1

(12) EX PARTE REEXAMINATION CERTIFICATE (9630th)

United States Patent
Hoehne et al.

(10) Number: US 7,060,922 C1
(45) Certificate Issued: May 3, 2013

(54) PUSH BUTTON SWITCH

(75) Inventors: George Hoehne, St. Charles, IL (US); Martin Peek, Hoffman Estates, IL (US)

(73) Assignee: Gamesman Limited, Crawley, West Sussex (GB)

Reexamination Request:
No. 90/009,392, Feb. 27, 2009

Reexamination Certificate for:

| | |
|---|---|
| Patent No.: | **7,060,922** |
| Issued: | **Jun. 13, 2006** |
| Appl. No.: | **10/827,128** |
| Filed: | **Apr. 19, 2004** |

(51) Int. Cl.

| | |
|---|---|
| ***H01H 9/00*** | (2006.01) |
| ***H01H 13/04*** | (2006.01) |
| ***G09F 13/22*** | (2006.01) |

(52) U.S. Cl.
USPC ..... 200/314; 200/310; 200/341

(58) Field of Classification Search
None
See application file for complete search history.

(56) References Cited

To view the complete listing of prior art documents cited during the proceeding for Reexamination Control Number 90/009,392, please refer to the USPTO's public Patent Application Information Retrieval (PAIR) system under the Display References tab.

*Primary Examiner* — Margaret Rubin

(57) ABSTRACT

A push button switch has a housing, a switch actuator movably supported by the housing, an organic light emitting diode display supported by the housing in a position to be viewable by a user of the push button switch, and a switch supported by the housing so as to operable by the switch actuator when the switch actuator moves relative to the housing. A controller circuit is electrically coupled to the push button switch so as to control the organic light emitting diode display in response to operation of the switch.

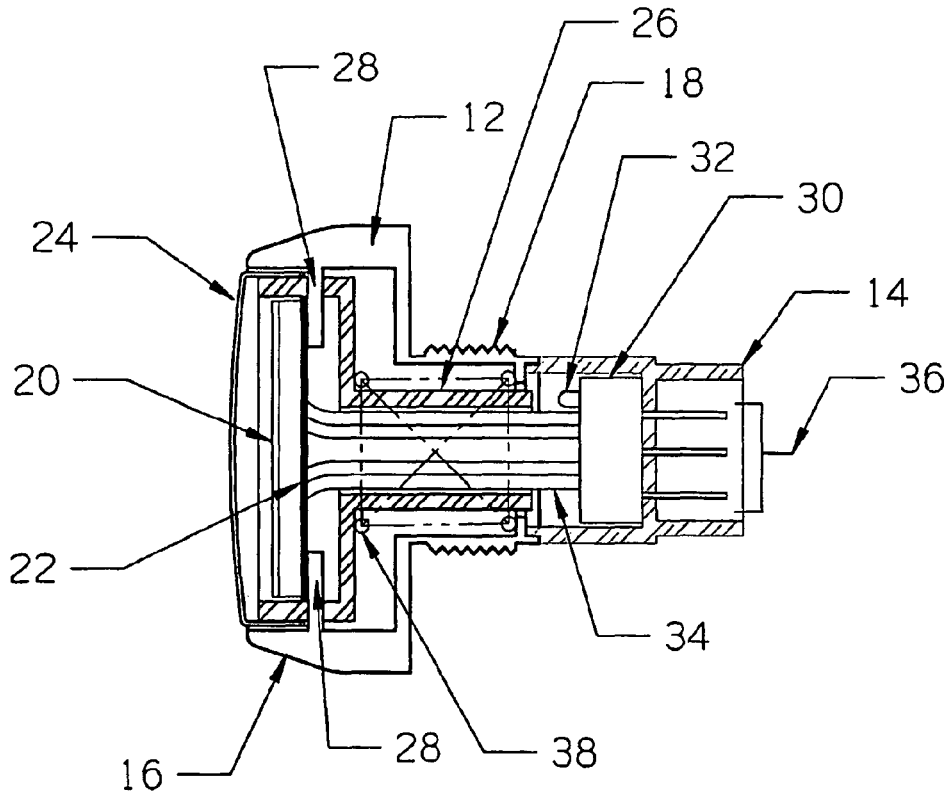

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-31 are cancelled.

* * * * *